United States Patent [19]

McDonald

[11] Patent Number: 4,952,766

[45] Date of Patent: Aug. 28, 1990

[54] SENSOR AND POP DETECTOR FOR MICROWAVE POPCORN CONTROL

[75] Inventor: Charles W. McDonald, Memphis, Tenn.

[73] Assignee: Microwave Products of America, Inc., Memphis, Tenn.

[21] Appl. No.: 181,494

[22] Filed: Apr. 14, 1988

Related U.S. Application Data

[63] Continuation-in-part of Ser. No. 113,646, Oct. 26, 1987, Pat. No. 4,873,409.

[51] Int. Cl.[5] ..... H05B 6/68

[52] U.S. Cl. ..... 219/10.55 B; 219/10.55 E; 219/506; 99/DIG. 14; 99/323.7; 73/861.18; 340/384 R

[58] Field of Search ..... 219/10.55 B, 10.55 R, 219/10.55 M, 10.55 E, 506, 509, 497; 340/384 R, 385; 99/323.7, 323.5, 325, 327, 328, 451, DIG. 14, 493; 426/234, 241, 243, 107, 113; 73/861.18, 861.25, 861.26–861.31

[56] References Cited

U.S. PATENT DOCUMENTS

| | | | |
|---|---|---|---|
| 3,467,804 | 9/1969 | Smith | 219/10.55 B |
| 3,931,757 | 1/1976 | Goode | 99/323.11 |
| 4,340,797 | 7/1982 | Takano et al. | 219/10.55 B |
| 4,381,439 | 4/1983 | Miyazawa et al. | 219/10.55 B |
| 4,520,250 | 5/1985 | Ishihara et al. | 219/10.55 B |
| 4,602,147 | 7/1986 | Gell | 219/509 |
| 4,672,180 | 6/1987 | Kusunoki et al. | 219/10.55 B |

OTHER PUBLICATIONS

Penwalt Kynar Piezo Film Product Summary and Price List, pp. 1–5, date unknown.

*Primary Examiner*—Philip H. Leung
*Attorney, Agent, or Firm*—Senniger, Powers, Leavitt and Roedel

[57] ABSTRACT

A closed-loop control for sensing the completion of popcorn popping in a microwave oven and automatically shutting down the oven. A microphone type sensor is acoustically coupled to the microwave oven cavity and provides an electrical signal to an amplifier and filter. The amplified and filtered signal is processed by a pop detector which includes an integrator and shutdown command generator responsive to a decreasing rate of popping to shut the oven off. The integrator provides a pre-pop timer function to maintain the oven on until popping commences. In an alternative sensor embodiment, a piezolelectric type sensor is used. In an alternative pop detector embodiment an adaptive threshold comparator which automatically adjusts pop detector operation to discriminate the popping signal from ambient noise present in the oven.

19 Claims, 9 Drawing Sheets

SENSOR AND POP DETECTOR FOR MICROWAVE POPCORN CONTROL

CROSS REFERENCE TO RELATED APPLICATIONS

This is a Continuation-In-Part of U.S. Patent Application Ser. No. 113,646 filed Oct. 26, 1987 now U.S. Pat. No. 4,873,409 issued Oct. 10, 1989.

BACKGROUND OF THE INVENTION

In the past, popcorn has been popped in microwave ovens with somewhat limited success. One approach has been to apply microwaves for a fixed period of time. This approach typically resulted in a substantially large number of unpopped kernels if too short or in scorching of the popped popcorn if the fixed time period was too long for the specific batch of popcorn placed in the oven. Because of the batch to batch variability, a fixed period of time that is optimum for one batch may over or under-cook another batch of the "same" type of popcorn.

Another approach has been to instruct a microwave oven user (for example on instructions on the container of popcorn specifically packaged for microwave popping) to listen to the popcorn popping and shut the oven off when popping slows down. For example, one instruction says to stop microwave when rapid popping slows to two to three seconds between pops. That same instruction says that the time will range from two to five minutes. This approach requires that the microwave oven user be present during the entire popping cycle and further that the user focus close attention to the popping. This method also suffers from variability in that the user is unlikely to precisely time the two to three second 0 interval resulting in user-to-user variability and even batch-to-batch variability with the same user, at least until that user has acquired the experience to know when to stop the oven.

SUMMARY OF THE INVENTION

The present invention provides an improved sensor and pop detector for an automatic closed-loop control of the popping cycle. The improved sensor utilizes a piezioelectric film element to monitor the popping, and the improved pop detector has an adaptive threshold comparator to discriminate popping pulses from background noise present in the oven.

DETAILED DESCRIPTION

Figure 1:
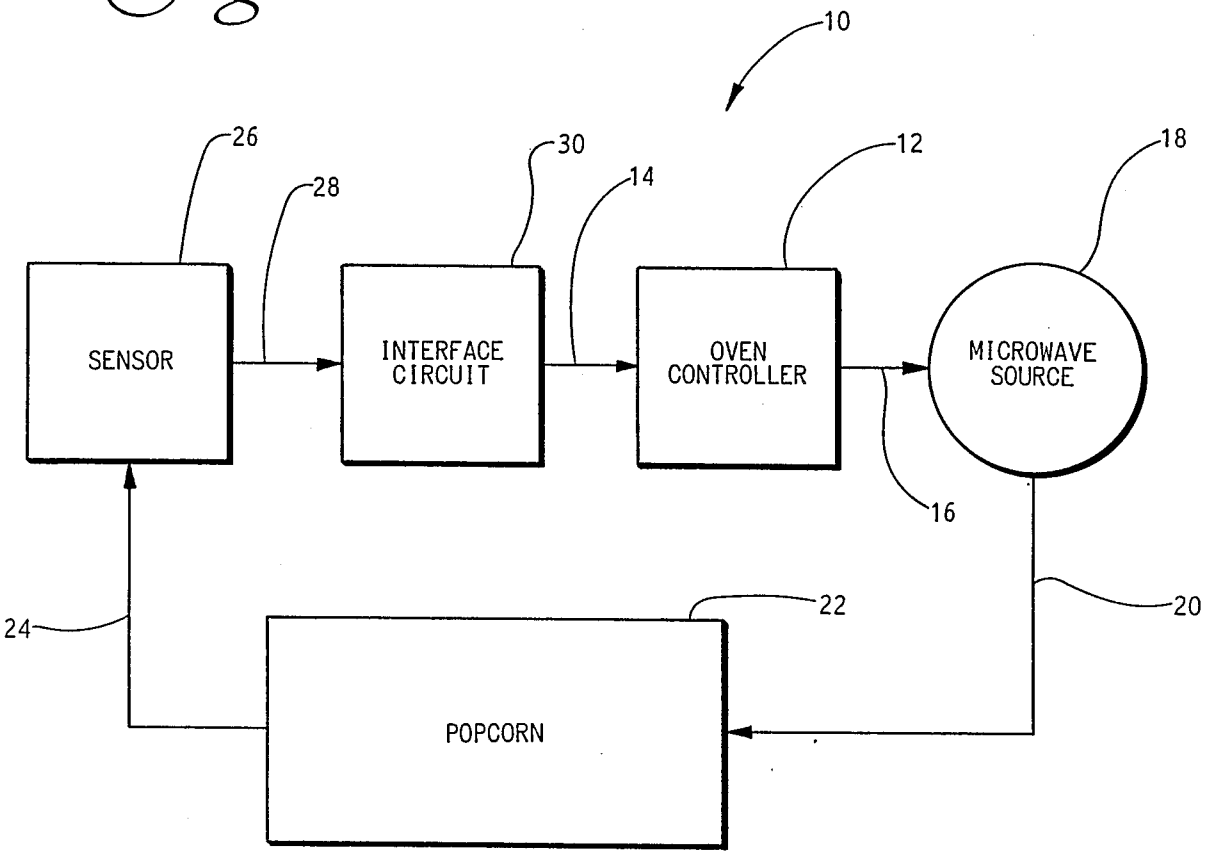
FIG. 1 shows the closed-loop block diagram of the present invention in combination with elements of a microwave oven and popcorn load.

Referring now to FIG. 1, a closed-loop control 10 for sensing the completion of popcorn popping in a microwave oven is shown in block diagram form. The control loop includes an oven controller 12 which may be either electro-mechanical or electronic, provided that it is responsive to a shut off command at input 14. Controller 12 has an output 16 to control a microwave source 18, such as a magnetron. When magnetron 18 is commanded "on" by the signal on line 16, microwave energy, indicated by arrow 20, is applied to a popcorn load 22 located in the microwave oven cavity (not shown). As popcorn 22 receives microwave energy 20, it commences popping, emitting acoustic energy 24 in the form of "pops" or impulses of sound. Energy 24 is coupled to an acoustic sensor or sound transducer 26 which provides an electrical output 28 representative of the energy 24. An interface circuit 30 has an input which receives the signal on line 28 and processes it so as to automatically provide a shut-off signal on line 14 when popcorn 22 is done popping, indicated by an end rate corresponding to the effective completion of popping. Because not every kernel in a batch can be popped without scorching the kernels already popped, the shut-off signal is made responsive to a decreasing level of popping of popcorn in the oven.

Figure 2:
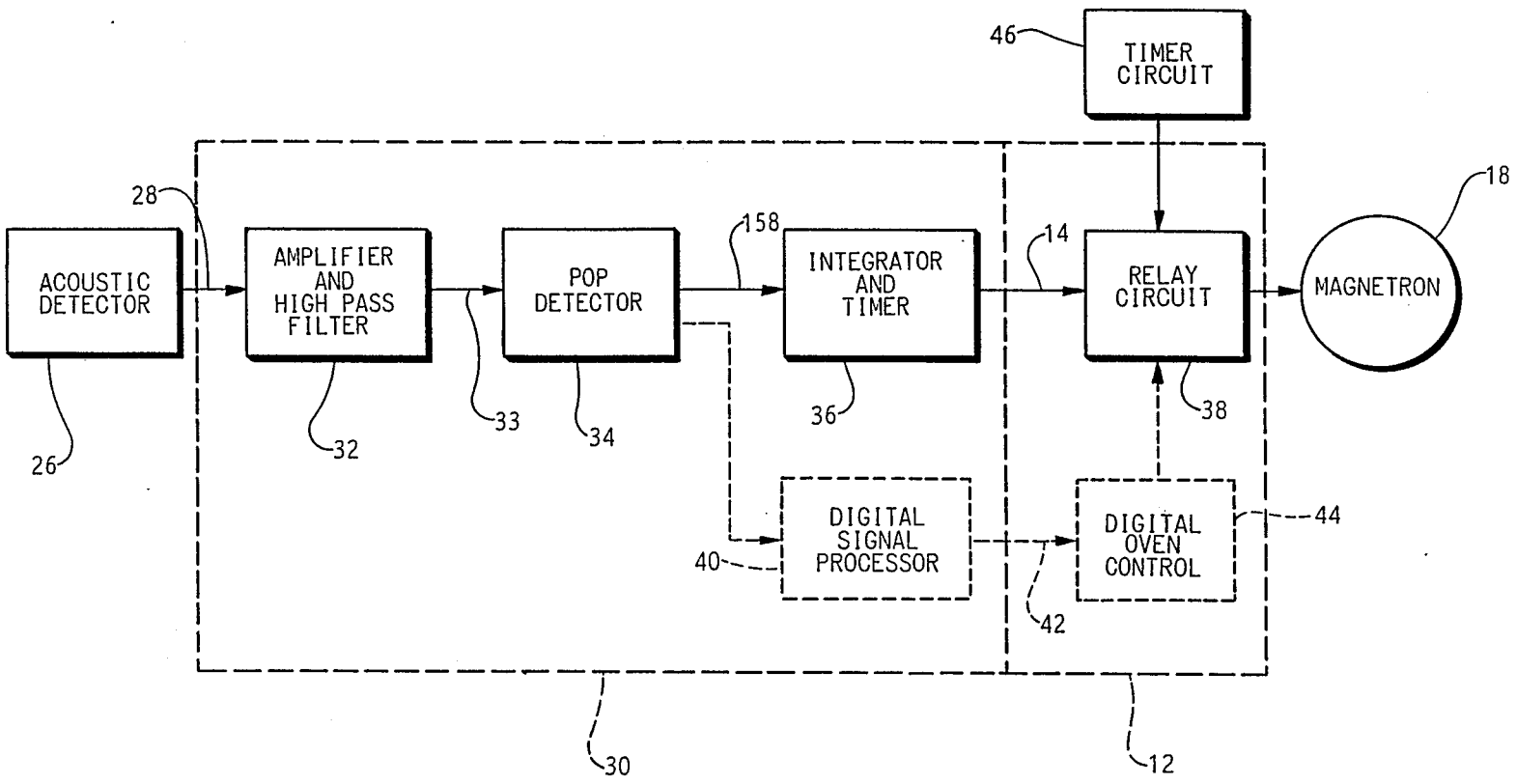
FIG. 2 shows a more detailed block diagram of an electronic control embodiment of the present invention including an alternative flow path for digital oven controls.

Referring now more particularly to FIG. 2, a portion of the control loop of FIG. 1 is shown in a more detailed block diagram. Specifically, interface circuit 30 may include an amplifier and high-pass filter block 32, a pop detector block 34, and an integrator and timer block 36. Oven controller 12 may be an electro-mechanical type, or may be a digital electronic control. If the microwave source 18 is a magnetron, controller 12 will ordinarily include a relay circuit 38 to interrupt high voltage to the magnetron. As an alternative to integrator and timer block 36, a digital signal processor 40 may be utilized to provide an appropriate command signal on line 42 to a microprocessor in a digital oven control 44. An additional timer circuit 46 may be utilized to shut off the microwave oven after a period of time set longer than the popcorn popping cycle to protect against extended oven operation in the event the oven is started without a batch of popcorn in the cavity.

Figure 3:
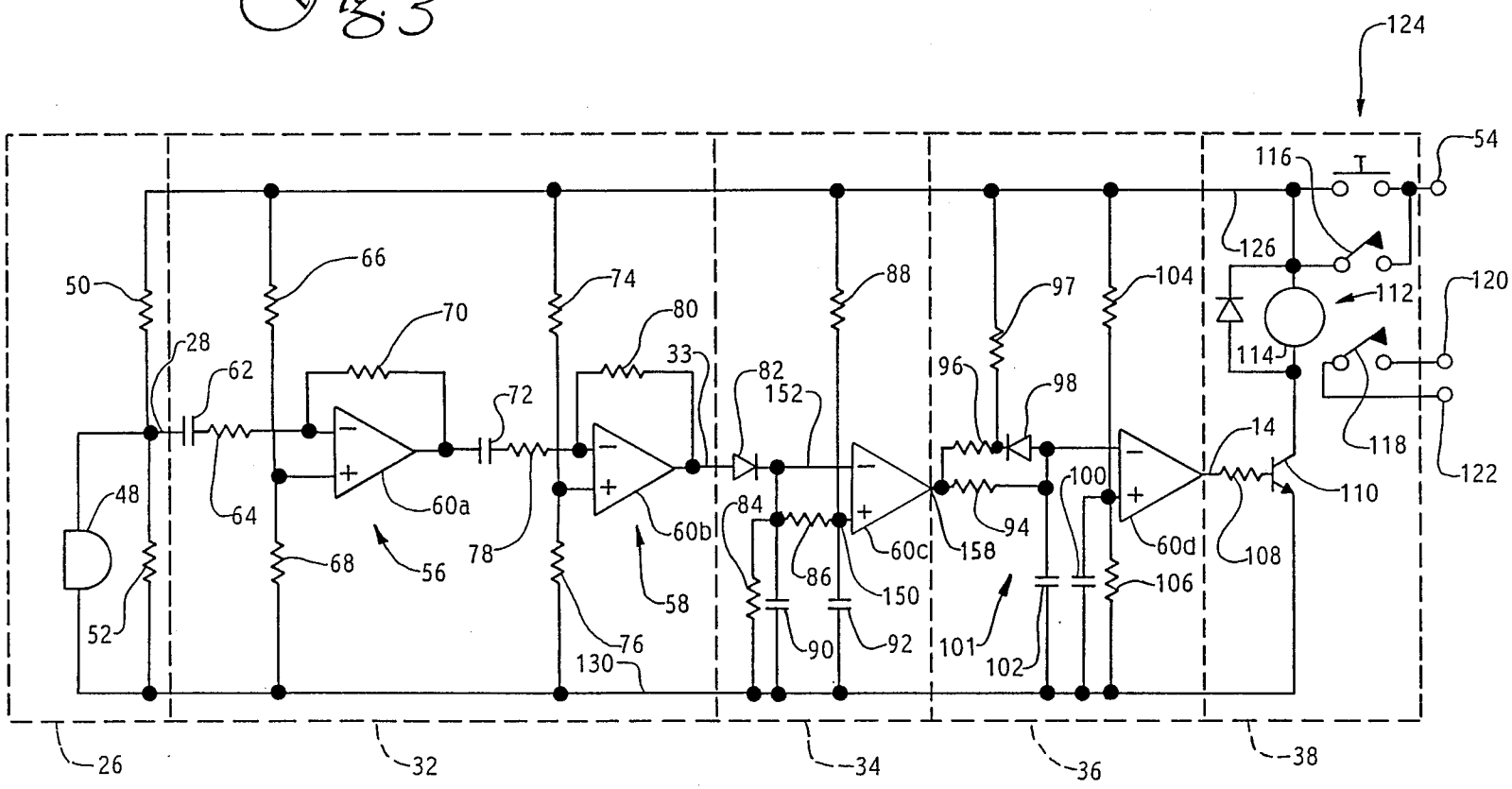
FIG. 3 shows a detailed schematic of the embodiment of FIG. 2 of the present invention.

Referring now more particularly to FIG. 3, a detailed schematic of portions of the embodiment of FIG. 2 may be seen. In this embodiment, acoustic detector 26 includes an electret microphone 48 which may be a Panasonic part number WM-034AY. Microphone 48 is biased by resistor 50, preferably 3K (ohms) and resistor 52, preferably 1.5K. It is to be understood that in this embodiment, power is preferably supplied at +15 volts DC through terminal 54.

Amplifier and filter block 32 preferably includes two amplifier stages 56, 58 each in the form of a first-order high pass filter. A type LM324 quad operational amplifier integrated circuit having four high gain amplifiers 60 a–d, available from National Semiconductor, has been found suitable for use in this application. Stage 56 includes a 0.01 uf capacitor 62, a 100K resistor 64, two 2 MEG (ohm) resistors 66, 68, a 1 MEG resistor 70 and amplifier 60*a*. Capacitor 62 and resistor 64 form a combined impedance which provides for a first order high pass filter characteristic. The gain of stage 56 is set by the ratio of the resistance of resistor 70 to the input impedance formed by the series combination of capacitor 62 and resistor 64. Amplifier 60*a* is biased for Class A operation by resistors 66, 68.

Stage 58 includes a 0.01 uf capacitor 72, two 2 MEG resistors 74, 76, a 100K resistor 78, a 1 MEG resistor 80, and amplifier 60 *b*. The elements of stage 58 perform in a similar fashion to those of stage 56.

Pop detector 34 preferably includes a conventional diode 82, such as a IN914, a 1 MEG resistor 84, a 1.8 MEG resistor 86, a 10 MEG resistor 88, a 0.22 uf capacitor 90, a 0.1 uf capacitor 92 and amplifier 60*c* connected as a comparator. As will be explained in more detail below, capacitors 90 and 92 provide a "floating reference" network for comparator 60*c* in order to enable comparator 60*c* to discriminate popcorn popping impulses from any remaining background noise in the signal on line 33 which may be caused by the cooling fan and other components. Resistors 84, 86 and 88 provide a biasing and discharge network at the input to comparator 60*c*.

The integrator and timer block 36 preferably includes a 910K resistor 94, a 33K resistor 96, a 39Kresistor 97, a IN914 diode 98, a 0.1 uf capacitor 100, a 150 uf capacitor 102, a 1 MEG resistor 104, a 1.2 MEG resistor 106, and amplifier 60*d* connected as a comparator. Capacitor 102 and resistor 94 form a relatively long time constant RC type integrator which integrates up in a first direction when output 158 of comparator 60*c* is high. Resistors 104, 106 set a trip point for comparator 60*d* at a voltage approximately equal to the voltage which would appear across capacitor 102 after one time constant of the combination of capacitor 102 and resistor 94. After some integration in the first direction, resistors 96 and 97 and diode 98 provide a rapid discharge path for capacitor 102 when output 158 is low. The asymptomatic value for the discharge, which may be thought of as integrating in a second direction, is set by a voltage divider formed by resisters 96, 97.

Relay circuit 38 preferably includes a 3K resistor 108, a conventional NPN switching transistor 110, and a relay 112 with a coil 114, a normally-open low voltage contact 116, and a normally-open high voltage contact 118. It is to be understood that contact 118 is connected in the high voltage supply to the magnetron via terminals 120, 122. A normally-open, momentary action switch 124 is connected between the +15 V DC supply 54 and the +V bus 126. It is to be understood that the oven will be "on" whenever relay 112 is energized, and that relay 112 is initially energized, along with the remainder of the elements shown in FIG. 3 upon closure of switch 124.

The operation of control 10 in a popcorn popping cycle is as follows: Power is supplied to bus 126 when switch 124 is closed and is maintained through contact 116 when switch 124 is released. Initially, even though microwave energy is applied for an initial time period, which may be fixed, there is no popcorn popping, and no pulses are detected by pop detector 34. Output 158 remains high, as does output 14 of comparator 60*d*, holding transistor 110 on, thus energizing relay 112. Sound transducer microphone 48 monitors the audible popping once it commences and provides an electrical signal on line 28, which is amplified and filtered by stages 56, 58 thus removing background noise from the signal representing the sound of popcorn popping in the microwave oven.

Capacitor 90 in pop detector 34 charges rapidly upon the occurrence of an impulse generated upon an instance of a kernel of corn popping in the oven. Capacitor 90 and 92 will "track" low frequency noise which may appear at the input to diode 82. Resistor 84 provides a discharge path for capacitor 90 to circuit common 130. The combination of resistors 84, 86 and 88 provide a voltage divider bias network for comparator 60*c* to provide a minimum threshold for a pop impulse, to avoid false switching of comparator 60*c*.

Circuit 36 includes a combined RC-type integrator and timer, followed by comparator 60*d*. In the absence of popping, the output of comparator 60*c* is held at a fixed level, close to the voltage on bus 126. When the output of comparator of 60*c* is at this level, capacitor 102 charges up in a first direction through resistor 94. While output 158 remains high, capacitor 102 charges at a rate set by resistor 94. When the voltage on capacitor on 102 exceeds the voltage at the plus summing junction of comparator 60*d*, the output 14 of comparator 60*d* switches low, shutting off transistor 110 and de-energizing relay 112. Ordinarily however, popping will occur before the voltage on capcitor 102 rises sufficiently to switch comparator 60*d*. When popping occurs, the output of comparator 60*c* is momentarily driven low, discharging capacitor 102. This delays switching of comparator 60*d* until popping slows to an end rate corresponding to the effective completion of popping. Once popping slows to this rate the output of comparator 60*d* will switch low, turning off transistor 110 and relay 112 by removing current from coil 114, thus opening contacts 116 and 118 and shutting off the oven. It is to be understood that the microwave oven controller 12 is deactivated when the time rate of popping of individual kernels of popcorn falls below a predetermined value.

Figure 4:
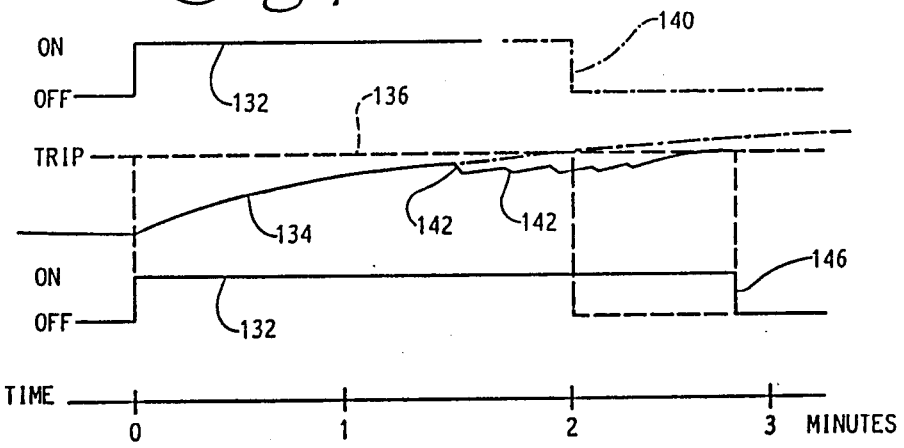
FIG. 4 shows waveforms corresponding to and illustrating the operation of FIG. 3.
Figure 5:
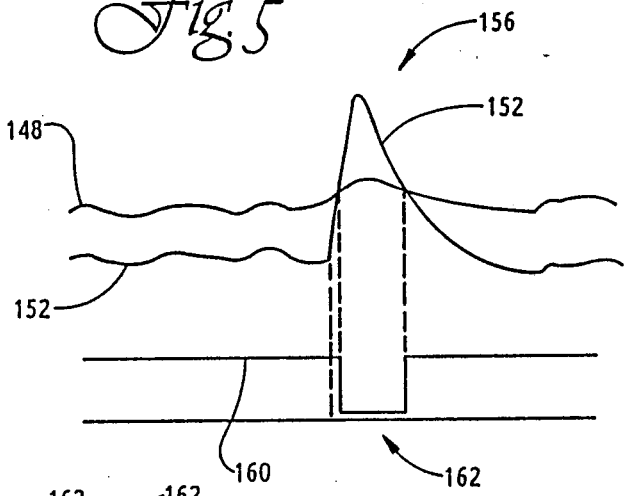
FIG. 5 shows an expanded view of the operation of the pop detector of FIGS. 2 and 3.
Figure 6:
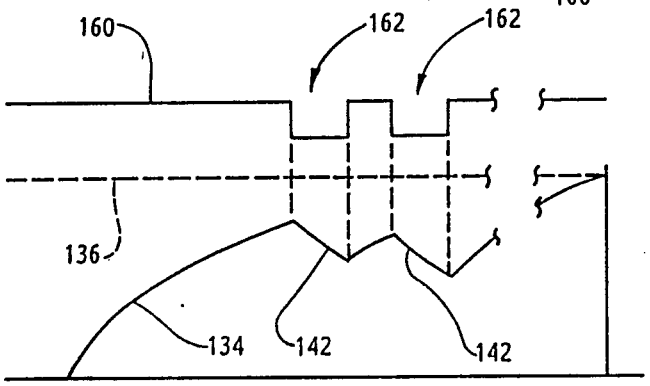
FIG. 6 shows an expanded view of a portion of FIG. 4 in connection with a waveform corresponding to FIG. 5.

Referring now also to FIGS. 4, 5 and 6 in addition to FIGS. 2 and 3, a pre-pop timer function is incorporated in block 36. This function, illustrated by waveform 132 is combined with the RC integrator 101 in block 36. Capacitor 102 of the RC integrator 101 begins to charge up as shown in waveform 134. While capacitor 102 is charging along exponential voltage rise 134, relay 112 is "on" as shown by waveform 132. In the absence of popping, waveform 134 will continue charging until trip point 136 of comparator 60*d* is reached, at which time relay 112 will switch "off" as shown at transition 140. If, however, popping commences before the timer of block 36 reaches transition 140, the integrator of block 36 will be partially reset by the action of comparator 60*c* acting through resistors 94, 96, 97 and diode 98, extending the time for the integrator 101 to reach the predetermined level 136. This partial resetting is indicated by segments 142 in waveform 134. It is to be understood that integration in the first direction is at a rate substantially slower than the rate of integration in the second direction. Waveform 134 is thus held below trip level 136 until popping slows down indicating the end of the popping cycle. Because the integrator in block 36 is partially reset, the relay 112 will not switch off at transition 140, but, instead, will switch off at transition 146 when the output 114 of comparator **60*d* switches from high to low. This partial resetting of the integrator of block 36 performs a time averaging function on the intervals between popping since the integrator capacitor 102** integrates down during each pop impulse and up in the intervals between pop impulses.

Referring now also to FIG. 5, the operation of pop detector 34 is illustrated. It is to be understood that because of capacitors 90 and 92 and resistor 86, the voltages at the positive and negative summing junctions of comparator **60*c* will track each other with an offset for a slowly changing signal at the output of block 32. This is illustrated by waveforms 148, 152 corresponding to the voltages at the positive and negative summing junctions 150, 154 respectively of comparator 60*c* When a pop is sensed by detector 26 and amplified by block 32, an impulse 156 will occur at the negative summing junction 154 of comparator 60*c*. When the voltage of waveform 152 exceeds that of waveform 148, the output 158 of pop detector 34 will transition from a high to a low state, illustrated by waveform 160. It is to be understood that the width of pulse 162 in waveform 160 is determined by both the height and the width of pop impulse 156. Each pulse 162 output from pop detector 34 causes a partial resetting or integrating down in a second direction of the integrator in block 36, as illustrated by segments 142 of waveform 134 in FIG. 6. Once popping slows down sufficiently for waveform 134 to reach trip level 136, block 36 provides a shut down or shut off command to the oven by switching comparator 60*d*** from a high to a low state output as described above.

Figure 7:
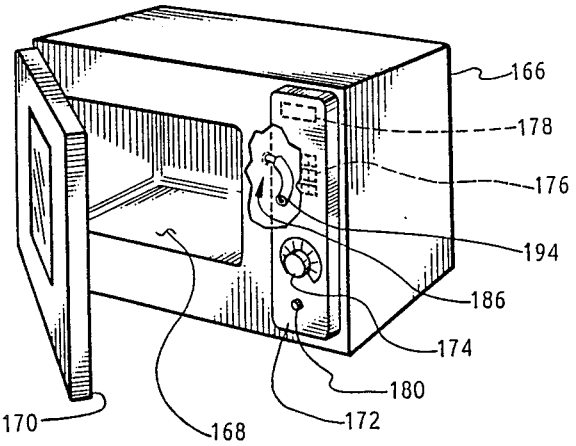
FIG. 7 is a partially cutaway view of a microwave oven illustrating certain mechanical aspects of the present invention.

Referring now to FIG. 7, a microwave oven 164 which utilizes the present invention may be seen partially cut away. Oven 164 has a housing 166 containing a cavity 168 and a door 170. Typically, oven 164 will include a control panel 172 which will have either a mechanical control input 174 such as a knob, or an electronic control input 176 such as a keyboard. Panel 172 may also have a display 178. Oven 164 preferably has a start button 180 accessible to a user of the microwave oven 164 to initiate operation of the oven by actuating switch 124.

Figure 8:
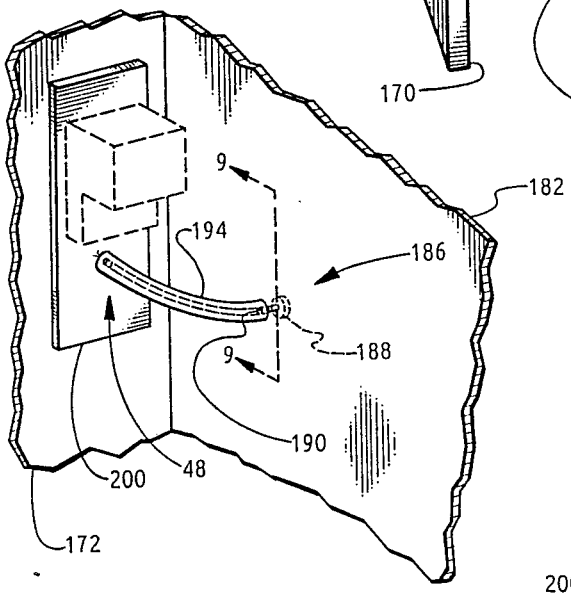
FIG. 8 is an enlarged cutaway view of a portion of the interior of the oven of FIG. 7.
Figure 9:
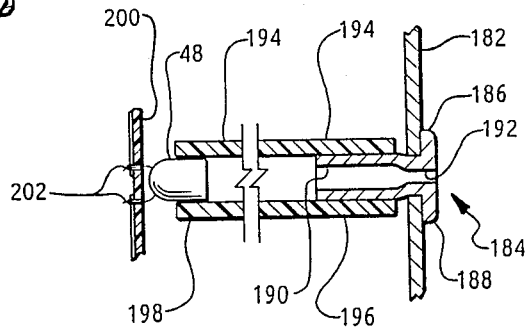
FIG. 9 is a partial section view taken along line 9—9 of FIG. 8.

Referring now also to FIGS. 8 and 9, cavity 168 has an interior wall 182 having an aperture 184 therein. Preferably, aperture 184 has a hollow rivet-like structure 186 having a flange 188 interior of the cavity and a projection 190 exterior of the cavity. Projection 190 may be swagged or enlarged to lock structure 186 to wall 182. It is to be understood that structure 186 is preferably metallic and contains a hollow internal region 192 of sufficiently small cross section to prevent the passage of microwaves therethrough thus functioning as a waveguide beyond cutoff. A first end 196 of a hollow tube or conduit 194 is received on projection 190. Tube 194 is preferably formed of flexible plastic suitable for coupling acoustic energy from aperture 184 to sensor 26. A second end 198 of tube 194 is received on microphone 48 which in one embodiment is preferably mounted to a printed circuit board 200 which may contain additional components of the microwave oven controller 12 and interface 30. Alternatively, aperture 184 may be used without structure 186, in which event aperture 184 is to be of sufficiently small cross section to prevent passage of microwaves. Tube 194 may be fastened to wall 182 in any suitable fashion, for example by adhesive, if desired.

Utilizing the structure of a hollow tube 194 or its equivalent permits convenient placement of sensor 48 while still maintaining acoustic coupling between sensor 48 and the aperture 184 in cavity wall 182. Utilizing structure 186 or an equivalent functioning as a waveguide beyond cutoff prevents microwave energy from reaching pickup or detector 48 and thus prevents microwave energy from interfering with the operation of detector 48. Alternatively, detector 48 may be located in close proximity to projection 190, with electrical leads 202 on detector 48 extending to board 200.

Figure 10:
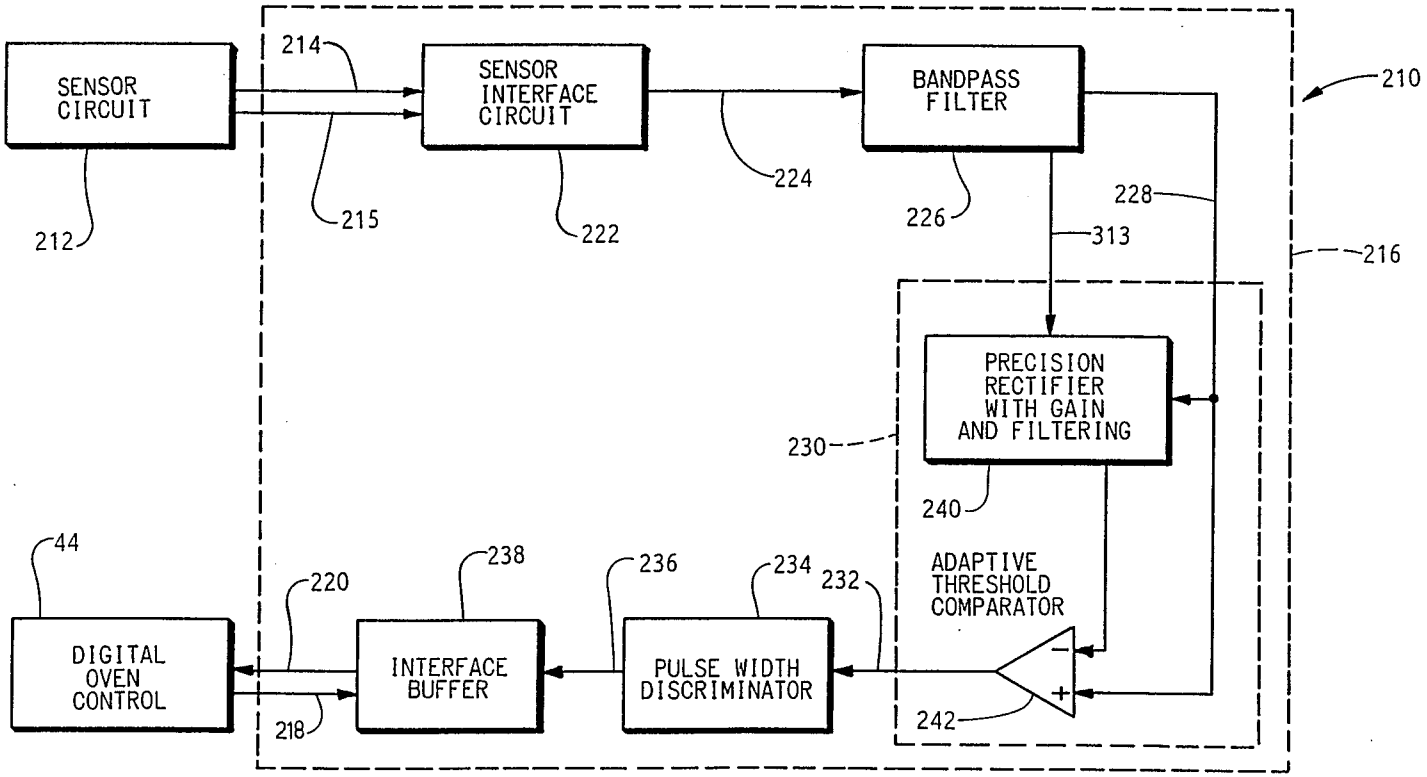
FIG. 10 shows a block diagram of an improved sensor and pop detector of the present invention.

Referring now to FIGS. 2 and 10, an alternative embodiment for Interface Circuit 30 may be seen. This embodiment may use the acoustic detector or sensor 26 of the previous embodiment, or it may use one of the alternative sensor circuits 212 described below.

It is to be understood that the system 210 of this alternative embodiment may accomplish some of the control functions of the previous embodiment through the use of software executed by Digital Oven Control 44. System 210 acoustically monitors the popcorn popping through Sensor Circuit 212 and provides an output representative of popping on line 214 to Interface System 216. When interrogated on line 218 by Digital Oven Control 44, Interface System 216 indicates to control 44 that popping pulses have been detected by holding line 220 high. Control 44 interrogates system 216 by sending pulses on line 218. System 216 will pull line 220 low when control 44 has sent a number of pulses on line 218 equal to the number of pulses detected by system 216. Although a negative supply is used in system 216, it is to be understood that a positive voltage power supply and a positive logic system alternative embodiment are within the scope of this invention.

Interface System 216 includes a Sensor Interface stage 222 which provides a signal at line 224 to a Band Pass Filter 226. Output 228 from Band Pass Filter 226 is an amplified and filtered signal representative of the output on lines 214 and 215 from Sensor Circuit 212 resulting from individual pops occurring in the microwave oven. It is to be understood that signal 228 may include ambient noise present in the microwave oven cavity which is detected and processed by Sensor Circuit 212. To eliminate or at least reduce this noise, signal 228 is supplied to an Adaptive Threshold Comparator circuit 230. Circuit 230 compensates for ambient noise by providing a signal on line 232 measured against a variable threshold adjusted by noise on line 228. A Pulse Width Discriminator 234 monitors the signal on line 232 and furnishes sequential output pulses on line 236 to an Interface Buffer 238, which stores such pulses until interrogated by Digital Oven Control 44.

To improve discrimination of the pop signal on line 228, and to make interface 216 suitable for use with various models of ovens having various background or ambient sound signatures, circuit 230 includes a Precision Rectifier with Gain and Filtering Circuit 240. Circuit 240 sets a trip point for comparator 242 equal to the average ambient noise times a gain constant. Rectifier circuit 240 allows the Adaptive Threshold Comparator Circuit 230 to discriminate the sound of popcorn popping from the ambient noise level, by adjusting the trip point of comparator 242 to be equal to a scaled value of the average noise for that oven.

Figure 11:
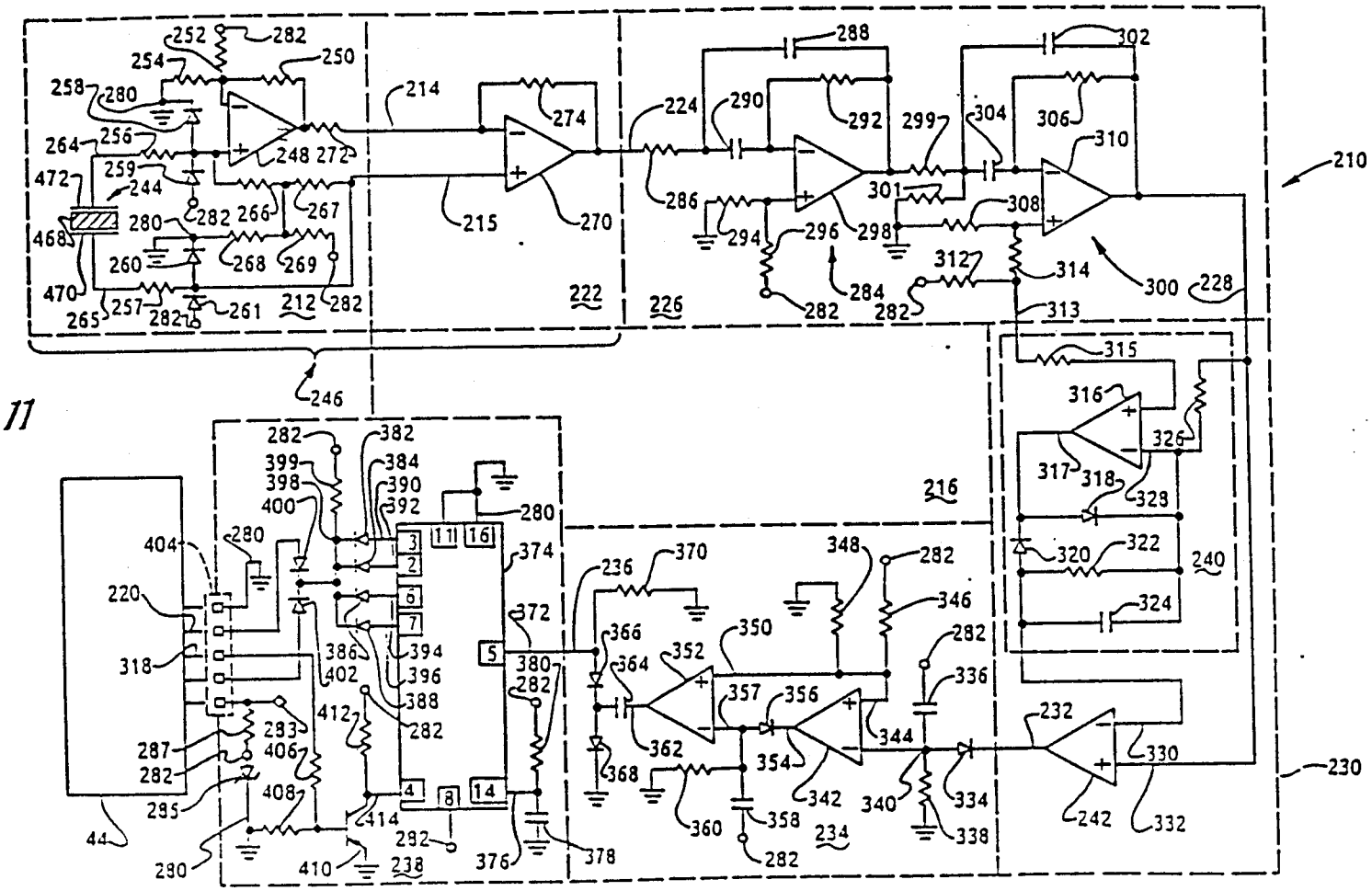
FIG. 11 shows a detailed schematic of the sensor and pop detector of the present invention.
Figure 14:
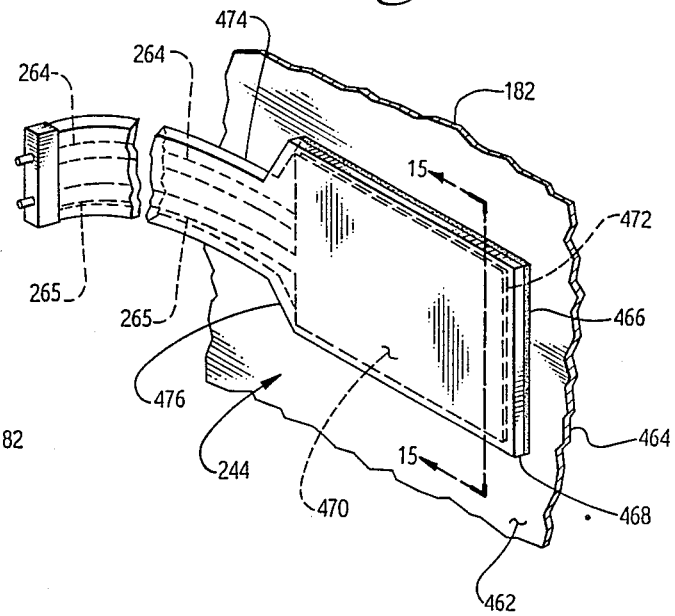
FIG. 14 is a partial cutaway view of a portion of the oven wall shown in FIG. 8 but with the improved sensor mounted thereon.

Referring now also to FIGS. 11 and 14, an acoustic sensor 244 may be formed of a Piezo film. Sensor 244 is preferably a custom designed element most nearly similar to a model SDTI-028K manufactured by Penwalt Corporation, Kynar Piezo Film Department, P.O. Box 799, Valley Forge, PA 19482, except replacing the wire leads with printed conductor leads and adding an additional 1 mil. thick mylar lamination layer on each exterior side of the transducer for electrical isolation.

Sensor 244 is connected to a differential amplifier circuit 246. Circuit 246 includes op amps (operational amplifiers) 248 and 270. In this embodiment all op amps and comparators are preferably from a type LM324 quad operational amplifier integrated circuit such as manufactured by National Semiconductor. In Sensor Circuit 212, amplifier 248 has a 4.7K feedback resistor 250 and a 91K input bias resistor 252 and a 100K resistor 254 connected to circuit common 280. A pair of 4.7K input resistors 256, 257 buffer Piezoelectric film sensor 244. Diodes 258–261 protect against input voltage spikes by clamping to circuit common 280 and the power supply $V_{zz}$ 282, which preferably is at −9.1 V DC. Circuit 246 also includes a pair of 560K resistors 266, 267 and a pair of 10K biasing resistors 268, 269.

Sensor Circuit output 214 is connected to the Sensor Interface 222 through lines 214 and 215. Stage 222 preferably has one op amp 270. Op amp 270 of circuit 246 has a 4.7K ohm input resistor 272 and a 47K feedback resistor 274. Output 224 of Sensor Interface Circuit 222 is connected to a first stage 284 of Band Pass Filter 226. First stage 284 includes a 680 ohm input resistor 286, a pair of 0.01 uf capacitors 288, 290, a 22K feedback resistor 292 and a pair of 43K balancing resistors 294, 296. The output of a first stage op amp 298 is connected to a voltage divider made up of a 2K resistor 301 and a 2K input resistor 299 of the second stage 300 of band pass filter 226. Second stage 300 also has a pair of 0.01 uf capacitors 302, 304, a 33K resistor 306, and a 56K input biasing resistor 308 for op amp 310. Input biasing for op amp 310 is also provided by a 100K resistor 312 and a 150 ohms resistor 314. Band Pass Filter 226 is a second order filter having three db break points at 2.5KHz and 4.5KHz. Resistors 308, 312 and 314 also provide biasing through a 220K resistor 315 for op amp 316 and Precision Rectifier 240. The feedback elements for op amp 316 include a pair of diodes 318, 320, a 1.2 meg ohm resistor 322, and a 1.0 uf capacitor 324. A 140K input resistor 326 provides a signal to the inverting input 328 of op amp 316. Output 317 of op amp 316 is connected to the inverting input 330 of comparator 242. The signal on line 228 is connected to the non-inverting input 332 of comparator 242.

Output 232 of the Adaptive Threshold Comparator 230 is connected through a diode 334 to a 0.1 uf capacitor 336 and a 20K resistor 338. Node 340 between capacitor 336 and resistor 338 is connected to the inverting input of a comparator 342. The non-inverting input 344 of amplifier 342 is connected to a bias network of a 120K resistor 346 and a 62K resistor 348, which in turn is also connected to the non-inverting input 350 of a comparator 352. The output 354 of comparator 342 is connected through a diode 356 to a 0.22 uf capacitor 358 and a 15K resistor 360. The output 362 of comparator 352 is connected through a 0.01 uf capacitor 364 to a pair of diodes 366, 368. Diode 366 is connected to a 56K ohm resistor 370 and a count up input 372 of a divide-by-16 binary up/down counter 374, preferably a type CD40193 as manufactured by RCA It is to be understood that because counter 374 has been designed by the manufacturer to be connected into a system having a positive power supply with respect to circuit common, the power supply and common connections for counter 374 are reversed in circuit 238. That is, pin 8 of a CD40193 counter is designated by the manufacturer to be connected to circuit common, while in the interface buffer circuit 238 of this invention, pin 8 is connected to $V_{zz}$ 282 which is desirably −9.1 volts. Similarly, pin 16 which is designated by the manufacturer to be connected to the +power supply, is connected to circuit common 280 in the interface buffer 238. Reset input 376 (pin 14) of counter 374 is connected to a 0.1 uf capacitor 378 and a 47K resistor 380 to clear counter 374 upon power up conditions. Diodes 382–388 connect outputs 390, 396 to node 398 which has a 47K resistor 399 also connected to it. Node 398 is further connected through a pair of diodes 400, 402 to Digital Oven Control 44 through connector 404. Node 398 is connected through line 220 as an output to Digital Oven Control 44. An input 218 from Digital Oven Control 44 passes through connector 404 to a 4.7 K resistor 406. A 10K resistor 408 maintains transistor 410 in the OFF condition in the absence of a signal on line 218. Transistor 410 is preferably a 2N4403 type PNP transistor. A 4.7K resistor 412 provides a pull-up function at the count down input 414 (pin 4) of counter 374.

$V_{zz}$ 282 is preferably provided from a more negative supply $V_{rr}$ 283, nominally −12 volts, fed through a 9.1V zener diode 285 and a 150 ohm ballast resistor 287. $V_{rr}$ 283 may be supplied from control 44 through connector 404 or may be provided by a conventional power supply (not shown).

SYSTEM OPERATION

Figure 12:
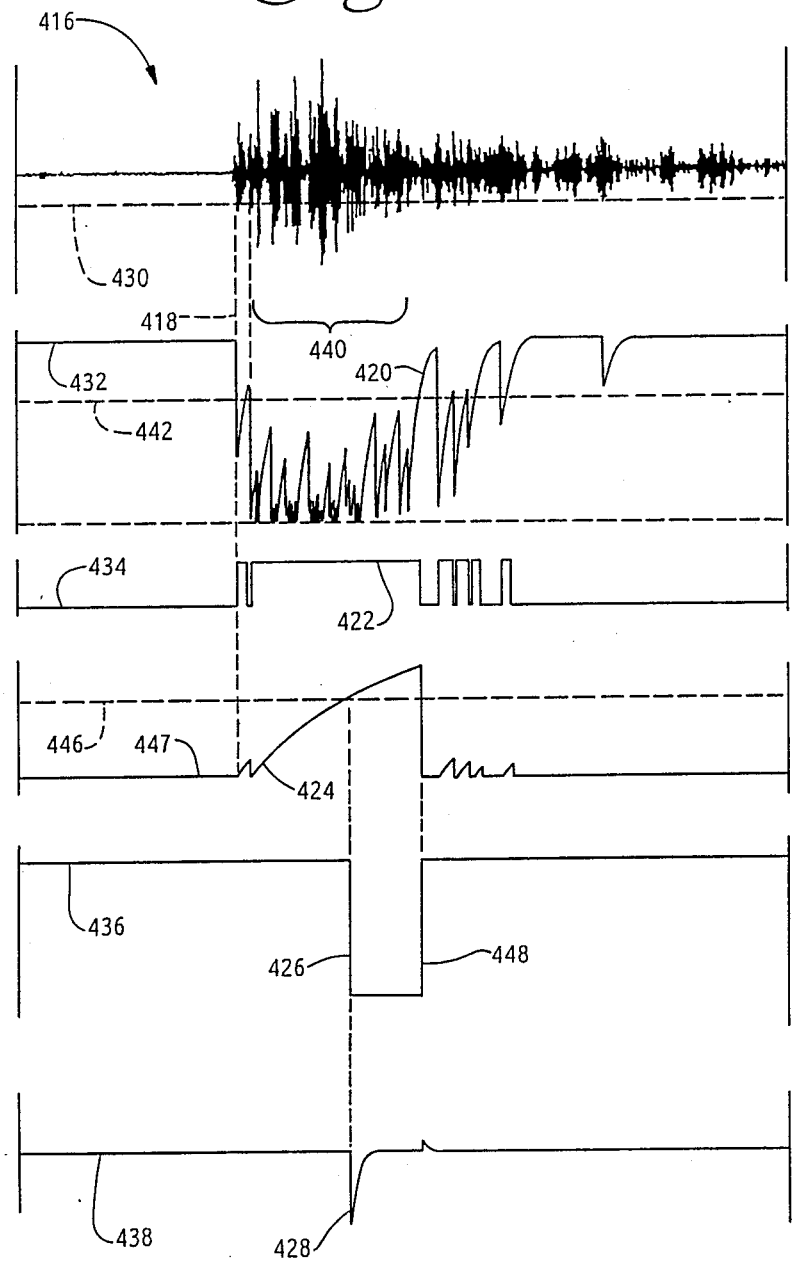
FIG. 12 shows various waveforms corresponding to FIG. 11.

Referring now also to FIG. 12, various waveforms illustrating the operation of system 210 are shown. Waveform 416 corresponds to the signal on line 228 as delivered by Band Pass Filter 226. Approximately 102 milliseconds are shown, with 30 milliseconds preceding line 418 and 72 milliseconds following line 418. Line 418 indicates the commencement of a "pop" which displays acoustic energy lasting for approximately 72 milliseconds in this sample. Waveform 420 corresponds to the signal at node 340 in the Pulse Width Discriminator circuit 234. Waveform 422 represents the output 354 of comparator 342. Waveform 424 represents the signal at node 357 connected to the inverting input of comparator 352. Waveform 426 represents the signal at output 362 of comparator 352. Waveform 428 represents the signal on line 236 delivered by Pulse Width Discriminator 234 to Interface Buffer 238. It is to be understood that each time a kernel of corn Pops, a waveform similar (but not identical) to waveform 416 will occur, and hence the resulting waveforms 420–428, will be generally similar, although not identical to those shown. The waveforms shown in FIG. 12 are for illustrative purposes in explaining the operation of the circuit.

In the quiescent state before a pop occurs (i.e. before line 418) the signal at node 340 is at a nominal zero volts, indicated at 432. Output 354 of comparator 342 is at its negative-most limit indicated at 434. The signal at node 357 is one diode drop above this voltage as indicated at 447 because of diode 356. Output 362 of comparator 352 is at the positive-most limit 436 and the Pulse Width Discriminator output 236 is held at a potential 438 of circuit common 280 because of pull-up resistor 370.

Upon the commencement of a pop (i.e., at line 418) signal 420 is pulled negative by output 232 of comparator 242 acting through diode 334 each time signal 416 on line 228 exceeds threshold 430. When the signal 416 is less than threshold 430, capacitor 436 is allowed to commence charging through resistor 338 causing node 340 to move towards quiescent state 432. Because the acoustic energy in region 440 of waveform 416 is relatively large, signal 420 is driven negative and remains below a threshold or trip point 442 for the duration of region 440. Trip level or point 442 for comparator 342 is set by the ratio of resistors 346 and 348.

Because region 440 is a region of high energy density, comparator 242 will hold signal 420 more negative than trip level 442 during the time or duration of region 440. Output 354 (represented by waveform 422) is held high during this high intensity period, permitting capacitor 358 to charge up along the waveform indicated at 424. Resistors 346 and 348 also set trip point or level 446 for comparator 352. As waveform 424 crosses trip level 446, comparator 352 switches from a high to a low indicated by waveform 426. This negative-going edge is coupled by capacitor 368 to counter 374 through diode 366 as indicated by the negative pulse in waveform 428. The positive-going edge 448 of waveform 426 is clamped by diode 368 and has no effect on counter 374. Thus, at least one pulse 428 is provided corresponding to acoustic energy 416 representative of a pop of popcorn. As the ambient noise level in an oven increases, block 240 will increase the threshold of comparator 242 adapting circuit 230 to the specific environment in which popping is to be sensed. This eliminates, or at least reduces the number of adjustments or circuit variations necessary to provide a pop detector suitable for use with a wide variety of models of microwave ovens.

When system 210 is used with a digital oven control 44 which has a microprocessor therein, Interface Buffer circuit 238 will temporarily store pop pulses until interegated by Digital Oven Control 44. Counter 374 may be expanded to any number of stages desired, however in FIG. 11, counter 374 is capable of accumulating and storing up to 15 pulses. Control 44 interrogates Interface Buffer 238 by sending a negative-going pulse on line 218, turning on transistor 410 and causing counter 374 to count down due to the presence of a negative pulse at line 414. Digital Control 44 continues to send pulses on line 218 while monitoring line 220. With no pulses stored in counter 374, resistor 399 pulls line 220 to a minus voltage. With one or more pulses stored in counter 374, output lines 390-396 will pull node 398 to zero volts. Since counter 374 must count down to zero before line 220 will change state, control 44 will be able to determine the number of counts stored in counter 374. Diode 402 is desirably connected through connector 404 to the power supply of Digital Control 44, which typically is at a smaller negative voltage than $V_{rr}$ 282. Diode 402 thus clamps the output line 220 from exceeding a safe level for control 44.

Figure 13:
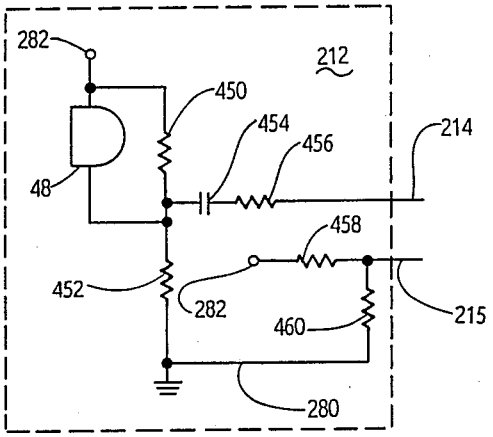
FIG. 13 shows an alternative sensor circuit useful with the improved pop detector of this invention.

Referring now to FIGS. 11 and 13, if it is desired to use microphone 48 in place of Piezoelectric transducer 244, sensor circuit 212 of FIG. 13 may be used in place of circuit 212 of FIG. 11, by connecting through lines 214 and 215 to the Sensor Interface Circuit 222. In this embodiment, microphone 48 (which is a condensor type) is biased by a 3.3K ohm resistor 450 and a 5.6K ohm resistor 452. A 0.01 uf capacitor 454 couples the output signal from microphone 48 through a 47K ohm resistor 456 to output line 214. Line 215 provides a bias signal to amplifier 270 as developed by a pair of 43K ohm resistors 458, 460.

Figure 15:
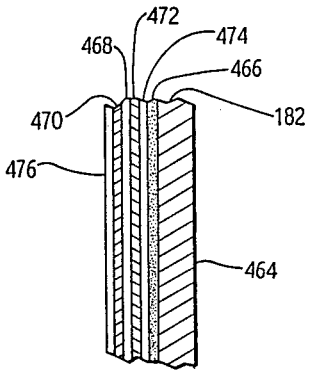
FIG. 15 is a partial section view along line 15—15 of FIG. 14.

Referring now more particularly to FIGS. 14 and 15, the improved sensor 244 of this invention may be seen. In FIG. 14, a perspective view of a portion of microwave oven cavity wall 182 is shown. Sensor 244 is adhesively secured to the exterior surface 462 of cavity wall 182. Interior surface 464 is the surface seen by a microwave oven user. Sensor 244 is desirably secured to surface 462 by an adhesive layer 466. It is to be understood that sensor 244 is comprised of a polyvinylidene fluoride film layer 468 offered by Pennwalt Corp under the trademark KYNAR. Layer 468 has a first metallization layer 470 on one side of the piezo effect film 468 and a second metallization layer 472 on the other side of the film 468. The respective metalization layers 470, 472 are connected to sensor circuit 212 by printed leads 265, 264 respectively. It is to be understood, that in this embodiment, the Piezoelectric film transducer 244 is mechanically coupled by adhesive 466 to the exterior surface 262 of a wall 182 of the microwave oven cavity 168 such that acoustic energy present in the cavity 168 is transduced into an electrical signal by the Piezoelectric film transducer 244. As may be seen in FIG. 15, sensor 244 is electrically insulated by a pair of 1 mil. mylar films 474, 476, each disposed to form an exterior surface of sensor 244.

The invention is not to be taken as limited to all of the details thereof as modifications and variations thereof may be made without departing from the spirit or scope of the invention.

What is claimed is:

1. The combination of a sensor and improved pop detector for an electronic control for popping corn in a microwave cavity of a microwave oven comprising: (a) sensor means for monitoring the accoustic energy in the microwave oven cavity and for providing an output signal representative thereof; b) means for determining a scaled value of ambient noise for the oven from the sensor output signal; and c) ambient noise rejection means for adaptively rejecting the determined ambient noise from the sensor output signal and providing a pop signal representative of the popping of popcorn in the microwave oven cavity.

2. The combination of claim 1 wherein the pop signal is a digital signal having at least one state change in response to the pop of an individual kernel of popcorn.

3. The combination of claim 1 wherein the ambient noise rejection means further comprises an adaptive threshold comparator.

4. The combination of claim 3 wherein the comparator threshold adapts to the ambient noise present in the cavity prior to the commencement of popping.

5. The combination of claim 4 wherein the comparator discriminates the popping signal from ambient noise present during popping.

6. The combination of claim 1 wherein the ambient noise rejection means further comprises a pulse bandpass filter connected to the sensor means.

7. The combination of claim 6 wherein the ambient noise rejection means further comprises a pulsewidth discriminator for providing the pop signal.

8. The combination of claim 1 wherein the sensor means further comprises a piezoelectric transducer adapted to be mechanically coupled to the microwave oven cavity.

9. The combination of claim 8 wherein the piezoelectric transducer further comprises a piezo film element adapted to be bonded to the microwave oven cavity.

10. The combination of claim 1 wherein the sensor means comprises a condensor microphone adapted to be acoustically coupled to the microwave oven cavity.

11. The apparatus of claim 1 wherein the determining means comprises means for providing a scaled value of average ambient noise for the oven from the sensor output signal.

12. In combination with a microwave oven having an oven cavity, an improved sensor assembly for detecting acoustic energy generated by an article present in the cavity of the microwave oven comprising a piezoelectric film transducer adapted to transduce acoustic energy generated by an article in the cavity, the piezoelectric film transducer being mechanically coupled to an exterior surface of the microwave oven cavity to thereby subject the transducer to acoustic energy generated by the article in the cavity whereby the acoustic energy generated by the article in the cavity is transduced into an electrical signal by the piezoelectric film transducer.

13. The combination of claim 12 wherein the transducer is bonded directly to the cavity.

14. The assembly combination of claim 13 wherein the transducer is bonded directly to a wall of the cavity.

15. The combination of claim 14 wherein the transducer is bonded directly to a wall of the cavity by an adhesive layer between the transducer and the wall.

16. An improved interface system for an electronic control for popping corn in a microwave oven comprising:

a) means for providing a pop signal representative of the popping of popcorn in a microwave oven cavity; and b) interface buffer means for accumulating a plurality of pop signals and for providing an output indicative of the number of pop signals accumulated upon demand.

17. The system of claim 16 wherein the interface buffer means further comprises a digital counter capable of storing a predetermined number of counts.

18. The system of claim 17 wherein the digital counter further comprises a count-up input for receiving successive pop signals, and an output network remaining in a first logic state when one or more pop signals are accumulated, and a second logic state when no pop signals are accumulated.

19. The system of 18 wherein the digital counter further comprises a count-down input adapted to receive individual successive pulses to interrogate the counter such that the output network will switch from the first logic state to the second logic state when the number of interrogation pulses received at the count-down input equals the number of pop signal pulses accumulated by the counter.

* * * * *